US006209618B1

(12) United States Patent
Chiang

(10) Patent No.: US 6,209,618 B1
(45) Date of Patent: Apr. 3, 2001

(54) SPOOL SHIELDS FOR PRODUCING VARIABLE THERMAL GRADIENTS IN AN INVESTMENT CASTING WITHDRAWAL FURNACE

(75) Inventor: Feng Chiang, Palm Harbor, FL (US)

(73) Assignee: Chromalloy Gas Turbine Corporation, San Antonio, TX (US)

( * ) Notice: Subject to any disclaimer, the term of this patent is extended or adjusted under 35 U.S.C. 154(b) by 0 days.

(21) Appl. No.: 09/304,994

(22) Filed: May 4, 1999

(51) Int. Cl.[7] ..... B22D 27/04
(52) U.S. Cl. ..... 164/338.1; 164/350; 164/352
(58) Field of Search ..... 164/338.1, 122.1, 164/122.2, 125, 127, 350, 352

(56) References Cited

U.S. PATENT DOCUMENTS

| | | | | |
|---|---|---|---|---|
| 3,810,504 | | 5/1974 | Piwonka | 164/60 |
| 3,897,815 | | 8/1975 | Smashey | 164/127 |
| 4,178,986 | | 12/1979 | Smashey | 164/251 |
| 4,969,501 | | 11/1990 | Brokloff et al. | 164/122 |
| 5,072,771 | * | 12/1991 | Prasad | 164/122.1 |
| 5,197,531 | * | 3/1993 | Hugo et al. | 164/122.1 |
| 5,778,961 | * | 7/1998 | Hugo et al. | 164/122.1 |

* cited by examiner

*Primary Examiner*—Harold Pyon
*Assistant Examiner*—I.-H. Lin
(74) *Attorney, Agent, or Firm*—Michael D. Bittman; Robert C. Faber

(57) ABSTRACT

A casting apparatus, comprising: a heating chamber having an open lower end defined by a periphery; a chill plate having a peripheral region for supporting one or more casting molds thereon and being in movable to move the molds from within the heating chamber to below the lower end of the heating chamber to withdraw the casting molds from the heating chamber; a cooling spool disposed at the periphery of the open lower end of the heating chamber and including a surface area for receiving heat energy radiated from at least one of the heating chamber and the casting molds; and a spool shield disposed at the cooling spool and movable to control an amount of the surface area of the cooling spool available for receiving the heat energy. In another embodiment there is an additional inner cooling spool movable inside the area surrounded by the casting molds for receiving radiant energy. A second spool shield at the inner spool controls its available surface area.

24 Claims, 3 Drawing Sheets

SPOOL SHIELDS FOR PRODUCING VARIABLE THERMAL GRADIENTS IN AN INVESTMENT CASTING WITHDRAWAL FURNACE

BACKGROUND OF THE INVENTION

1. Field of the Invention

The present invention relates to an apparatus for solidifying a casting to create a directionally solidified or single crystal casting and, more particularly, to an apparatus which is capable of introducing a cooling spool into a casting mold and withdrawing the casting mold from a stationary heating chamber.

2. Related Art

Solidifying molten materials, such as molten metal, in a mold cavity to create a directionally solidified or single crystal casting is known. FIGS. 1*a* and 1*b* illustrate a conventional apparatus 10 for producing a casting. An example of this is disclosed in U.S. Pat. No. 4,969,501. The apparatus 10 includes a heating chamber 12 defining an interior volume 16 which is heated via heating elements 14. A plurality of casting molds 20 are disposed in an annular array on a vertically movable chill plate 22. The molds are supported in and removable from the interior volume 16 by the movable plate 22. The movable plate 22 is vertically displaced by column 24. More particularly, the casting molds 20 may be removed from the interior volume 16 by displacing the plate 22 in the direction of arrow A (FIG. 1*b*) while the heating chamber 12 remains stationary.

Unfortunately, apparatus 10 produces directionally solidified or single crystal castings having less desirable material properties due to lower thermal gradient during casting. A thermal baffle or heat sink is not introduced into an interior region of the casting mold apparatus during the withdrawal from the heating chamber 12 to selectively absorb radiant heat being supplied from the molds 20. Indeed, there is very little if any control of thermal gradients at the molds 20 to obtain directionally solidified castings.

In order to obtain a directionally solidified or single crystal casting, a casting mold must be removed from a heating chamber using special procedures.

FIGS. 2*a* and 2*b* show another conventional apparatus 50 to produce a directionally solidified or single crystal casting. An example of this is disclosed in U.S. Pat. No. 5,778,961. The apparatus 50 includes a heating chamber 12 defining an interior volume 16 for receiving an annular array of casting molds 20. The casting molds 20 surround and define an interior space 21. The molds are disposed on an annular chill plate or disk 30 which includes a central aperture 31. A thermal baffle or heat sink 34 us shaped and sized to pass through the aperture 31 in the plate 30, and the baffle is movable vertically upward in the direction of arrow C (FIG. 2*b*) with respect to the plate 30 by its supporting column 36. In particular, the thermal baffle 34 may be moved into the interior space 21 by moving the column 36 upward, and vice versa. The radiation baffle 19 is disposed below the open end of the heating chamber 12.

As illustrated, the casting molds 20 are maintained in a substantially fixed position and height with respect to a floor 32. The casting molds 20 are removed from the interior volume 16 of the heating chamber 12 by raising the heating chamber 12 in the direction of arrow B (FIG. 2*b*). Thermal baffle 34 may be moved into interior space 21 while the heating chamber 12 is moved. Of course, the chamber 12 can remain stationary and the molds may be moved out downwardly.

The thermal baffle 34 serves as a heat sink to absorb radiant heat from the molds 20 such that the molten material within the molds 20 is solidified directionally by a thermal gradient defined from the heating chamber 12 to the thermal baffle 34. The thermal gradient is a function of the temperature difference and relative positions of the heating chamber 12 and the thermal baffle 34. Therefore, the higher is the temperature of the heating chamber 12 and the greater is the magnitude of heat that the thermal baffle 34 can absorb, the higher are the thermal gradients obtained.

Since the thermal baffle 34 may be moved relative to the molds 20, the thermal gradient may be controlled to some extent. Unfortunately, apparatus 50 only maximizes the thermal gradient and, therefore, does not satisfactorily provide the thermal gradient control needed to produce castings of different geometries and configurations or single components having substantially complex geometries and still result in desirable directionally solidified or single crystal articles.

Moreover, when a component is manufactured in a fixed thermal gradient system as shown in FIG. 2*a*–2*b*, the constant thermal gradient applies to the entire article and is normally not optimized over respective areas of the article. Constant, and particularly high thermal gradients may cause increases in casting scrap because hot tear prone alloys may crack as a result of thermal stresses due to the high thermal gradient.

Accordingly, there is a need in the art for a directionally solidified or single crystal casting apparatus which provides a high degree of control of thermal gradients when withdrawing casting molds from a heating chamber.

SUMMARY OF THE INVENTION

In order to overcome the disadvantages of the prior art, the casting apparatus of the present invention includes a heating chamber having a substantially open lower end. An outer cooling spool is disposed at the periphery of the open lower end of the heating chamber. A chill plate is movable through the lower end of the heating chamber from the lower end of the chamber to below that end by movement of at least one of the chill plate or the heating chamber.

A mold assembly is receivable into the lower end of the heating chamber via the movable chill plate. The assembly includes at least one, and typically includes an annular array of a plurality of mold cavities peripherally disposed around the chill plate.

A movable spool shield is disposed proximate to the outer cooling spool and operable to vary an amount of surface area of the outer cooling spool available for absorbing radiant heat from the heating chamber.

In an alternate embodiment, there is an additional inner cooling spool movable inside the area surrounded by the casting molds for receiving radiant energy. A second spool shield at the inner spool controls its available surface area.

Other objects, features, and advantages of the casting apparatus of the present invention will become apparent to those skilled in the art in view of the description below taken in conjunction with the accompanying drawings.

BRIEF DESCRIPTION OF THE DRAWING

For the purpose of illustrating the invention, there are shown in the drawing forms which are presently preferred, it being understood, however, that the invention is not limited to the precise arrangements and instrumentalities shown.

DESCRIPTION OF THE PREFERRED EMBODIMENTS

Figure 1A:
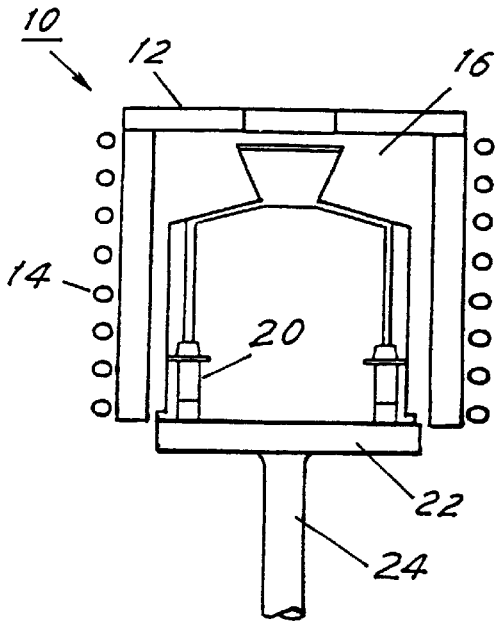
FIG. 1a PRIOR ART
FIG. 1*a* is a side sectional view of a casting apparatus according to one embodiment of the prior art.
Figure 1B:
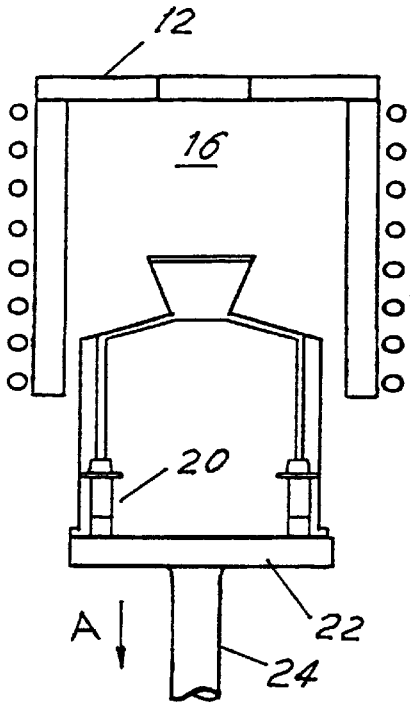
FIG. 1b PRIOR ART
FIG. 1*b* is a side sectional view of the casting apparatus of FIG. 1*a* where casting molds are being withdrawn.
Figure 2A:
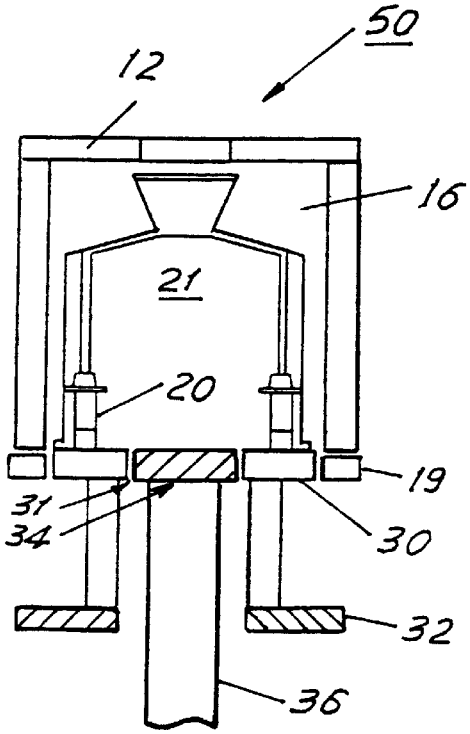
FIG. 2a PRIOR ART
FIG. 2*a* is a side sectional view of a casting apparatus according to another aspect of the prior art.
Figure 2B:
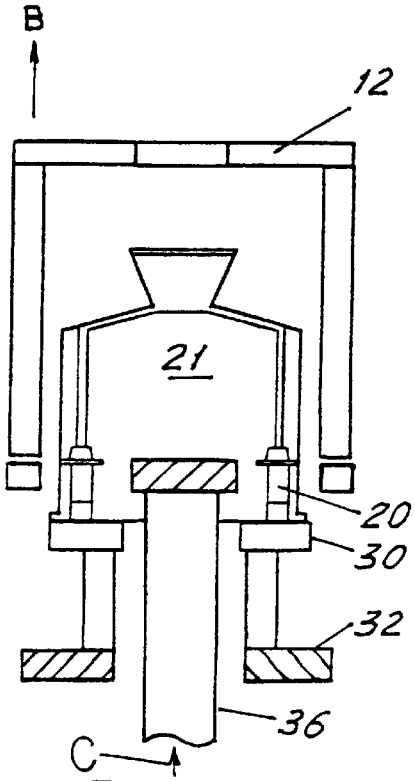
FIG. 2b PRIOR ART
FIG. 2*b* is a side sectional view of the casting apparatus of FIG. 2*a* where its heating chamber is being removed.
Figure 3A:
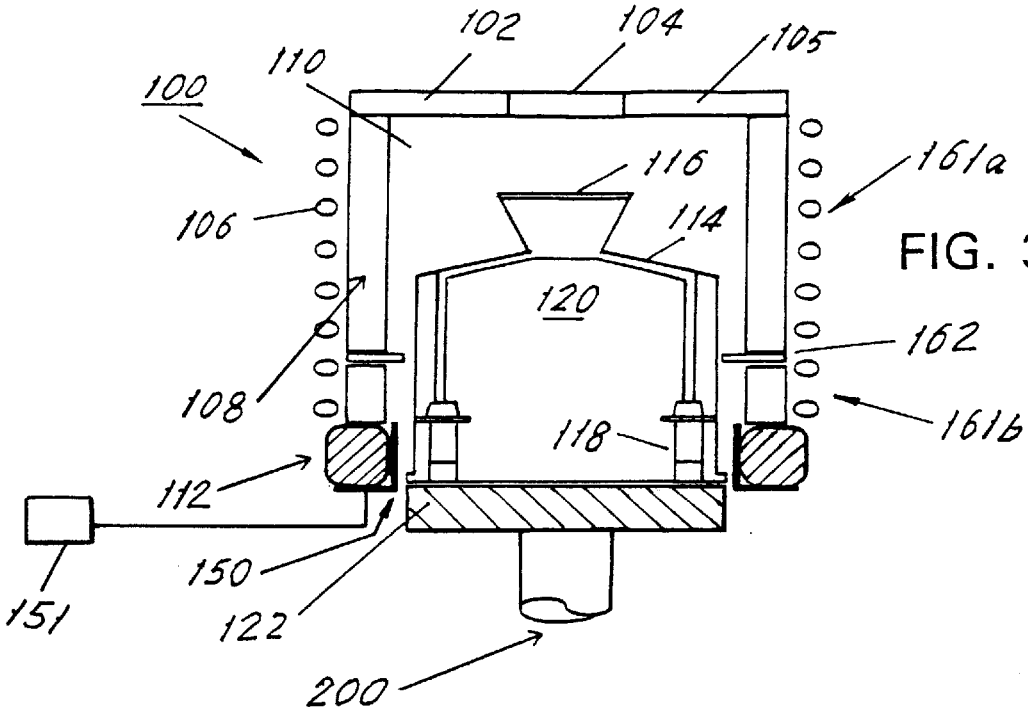
FIG. 3*a* is a side sectional view of a casting apparatus according to the present invention.

FIG. 3*a* shows an elevational sectional view of a casting apparatus 100 according to a first embodiment of the present invention. The casting apparatus 100 includes a substantially stationary heating chamber 102 (or a susceptor when induction coils are used as the mold heater 106) having a pouring opening 104 through hood 105 for receiving moldable liquid (molten metal), located at its top end, and an open lower end spaced below the pouring opening 104 through hood 105. The heating chamber 102 includes a mold heater 106, preferably formed by electric induction coils wrapped around walls 108 of the heating chamber (susceptor) 102. Preferably, the heating chamber 102 is in the form of a cylinder having an interior volume 110 accessible through the open lower end and heated by the mold heater 106, typically induction coils or resistant heaters. The heating chamber 102 is divided into two heating zones 161*a* and 161*b* separated by baffle 162.

An outer cooling spool 112 is disposed about and just below the periphery of the open lower end of the heating chamber 102. The outer cooling spool 112 is preferably substantially ring-shaped so that the open lower end of the heating chamber 102 is not substantially obstructed. The outer cooling spool 112 includes a central surface area 112*a* facing radially inwardly and includes a lower surface area 112*b* facing substantially downward. The outer cooling spool 112 is capable of absorbing radiant heat. The outer cooling spool 112 is preferably formed from a fast thermal conducting material such as a copper or steel material and is internally water cooled.

The casting apparatus 100 also includes mold apparatus (casting mold) 114 which includes an annular array of a plurality of mold cavities 118, as is known in art. In one preferred application, each of the mold cavities is shaped to form a turbine airfoil for an aircraft engine. The annular mold apparatus 114 defines an interior space 120. The mold apparatus 114 includes a pouring basin 116 which receives the molten metal and communicates (connects) with the mold cavities 118.

The heating chamber 102 and the mold apparatus (casting mold) 114 are sized and shaped such that the mold apparatus 114 may be received within the interior volume 110 of the heating chamber 102. Preferably, the heating chamber 102 remains substantially stationary while the mold apparatus 114 is movable vertically into and out of the interior volume 110 through the open lower end of the heating chamber 102 by way of an elevator mechanism 200.

The elevator mechanism 200 includes a chill plate 122 which is movable with respect to the substantially open, stationary lower end of the heating chamber 102. The chill plate 122 is preferably annular to support the annular mold apparatus 114. The chill plate 122 is sized and shaped such that it may pass coaxially through the outer cooling spool 112 and the open lower end of the heating chamber 102. It is preferred that the chill plate is formed of a fast thermal conductor material such as copper and/or steel and is internally water cooled, the water being provided through mechanism 200.

To obtain directionally solidified or single crystal castings, it is important, among other things, to control temperature gradients at the mold cavities 118 as the mold apparatus 114 is removed from the heating chamber 102 and while the castings cool.

The outer cooling spool 112 serves as a heat sink to absorb radiant heat from the mold apparatus 114 which has been preheated in the heating chamber 102. In particular, the outer cooling spool 112 absorbs the radiant heat from below the heating chamber 102 such that molten material within the mold apparatus 114 is solidified directionally by a thermal gradient defined from the heating chamber 102 to the outer cooling spool 112. The thermal gradient is a function of the temperature difference between the heating chamber 102 and the outer cooling spool 112. Therefore, the higher the temperature of the heating chamber 102, the greater the magnitude of heat that the outer cooling spool 112 can absorb, and thus higher thermal gradients are obtained.

Figure 3B:
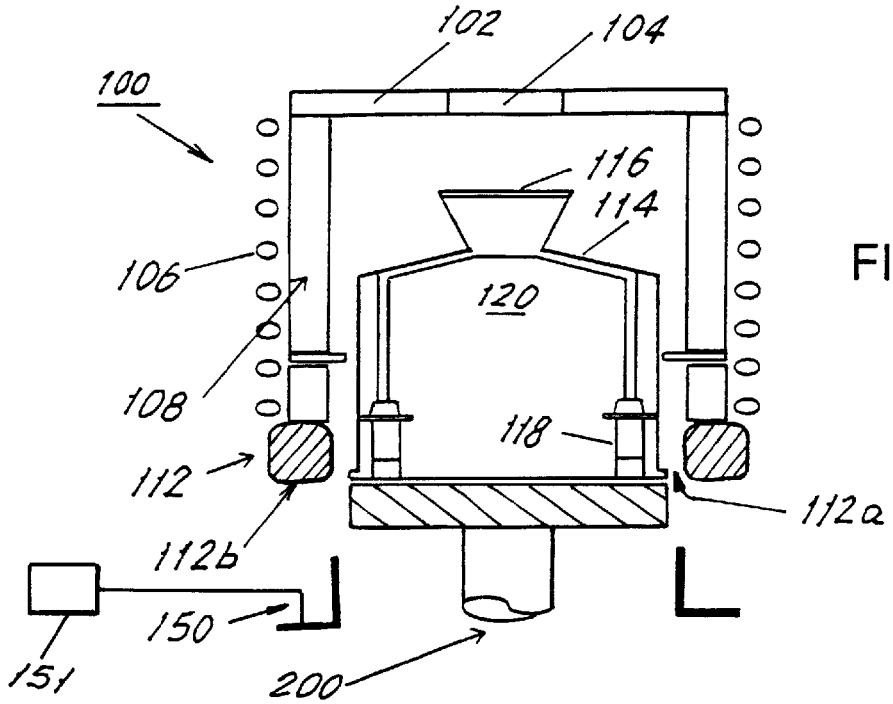
FIG. 3*b* is a side sectional view of the casting apparatus of FIG. 3*a* where the spool shield has been moved.

The thermal gradient from the heating chamber 102 to the outer cooling spool 112 is also a function of the surface area of the outer cooling spool 112 exposed to radiant heat. The casting apparatus 100 of the present invention includes an outer spool shield 150 which can shield the spool or be moved off it. FIG. 3*b* shows the outer spool shield 150 spaced away from the outer cooling spool 112. The outer spool shield 150 is preferably independently adjustable by adjustment means 151 with respect to the withdrawal of the mold apparatus 114 from the heating chamber 102. The outer spool shield generally covers the inner surface of the cooling spool and could cover the entire inner surface. In one embodiment, the spool shield 150 can be an L-shaped cross section with a first part facing radially inward into the heating chamber 102 and a second part facing downward to cover the respective radially inwardly facing and downwardly facing surfaces 112*a*, 112*b* of the outer cooling spool 112.

At least a portion of the outer surface of the outer spool shield 150 includes a reflective surface that is directed substantially towards the mold apparatus 114 and reflects radiant heat energy back toward the mold apparatus 114. The reflective surface of the outer spool shield 150 preferably includes a monolithic refractory material, such as high purity alumina or zirconia, although other similarly functioning materials may be employed for the invention. The outer spool shield 150 may be formed in segments to obtain, for example, a 360° cylindrical shield capable of thermally isolating the outer cooling spool 112 from the heating chamber 102 and the mold apparatus 114.

The outer spool shield 150 is movable axially or vertically by its adjustment means 151 to vary an amount of surface area of the outer cooling spool 112 available for receiving radiant heat energy from the heating chamber 102 and/or the mold apparatus 114. As the outer spool shield 150 is moved away from and exposes more surface area of the outer spool shield 112, the thermal gradient from the heating chamber 102 and/or the mold apparatus 114 to the outer cooling spool 112 is increased. According to the present invention, it is desirable to vary the thermal gradient between the heating chamber 102 and the outer cooling spool 112 to achieve desirable directionally solidified castings.

Since the outer spool shield 150 is capable of reflecting radiant heat energy, its position relative to the heating chamber 102 and/or the mold apparatus 114 can further reduce or increase the thermal gradient. The thermal reflectivity of the outer spool shield 150 may be increased where it faces the casting apparatus 114 by machining or coating with an appropriate material.

These refractory materials are capable of sustaining high temperatures, sometimes in exceed of 3,000° F., making them particularly suitable for the present invention.

The movement of the outer cooling shield 150 is preferably controlled by a programmable logic control, the means 151, (such as a microprocessor under software control) or any other automation control device (not shown) to achieve a varying thermal gradient profile specific to the particular geometry or other specifications of the casting to achieve a more optimally directionally solidified article.

Figure 4:
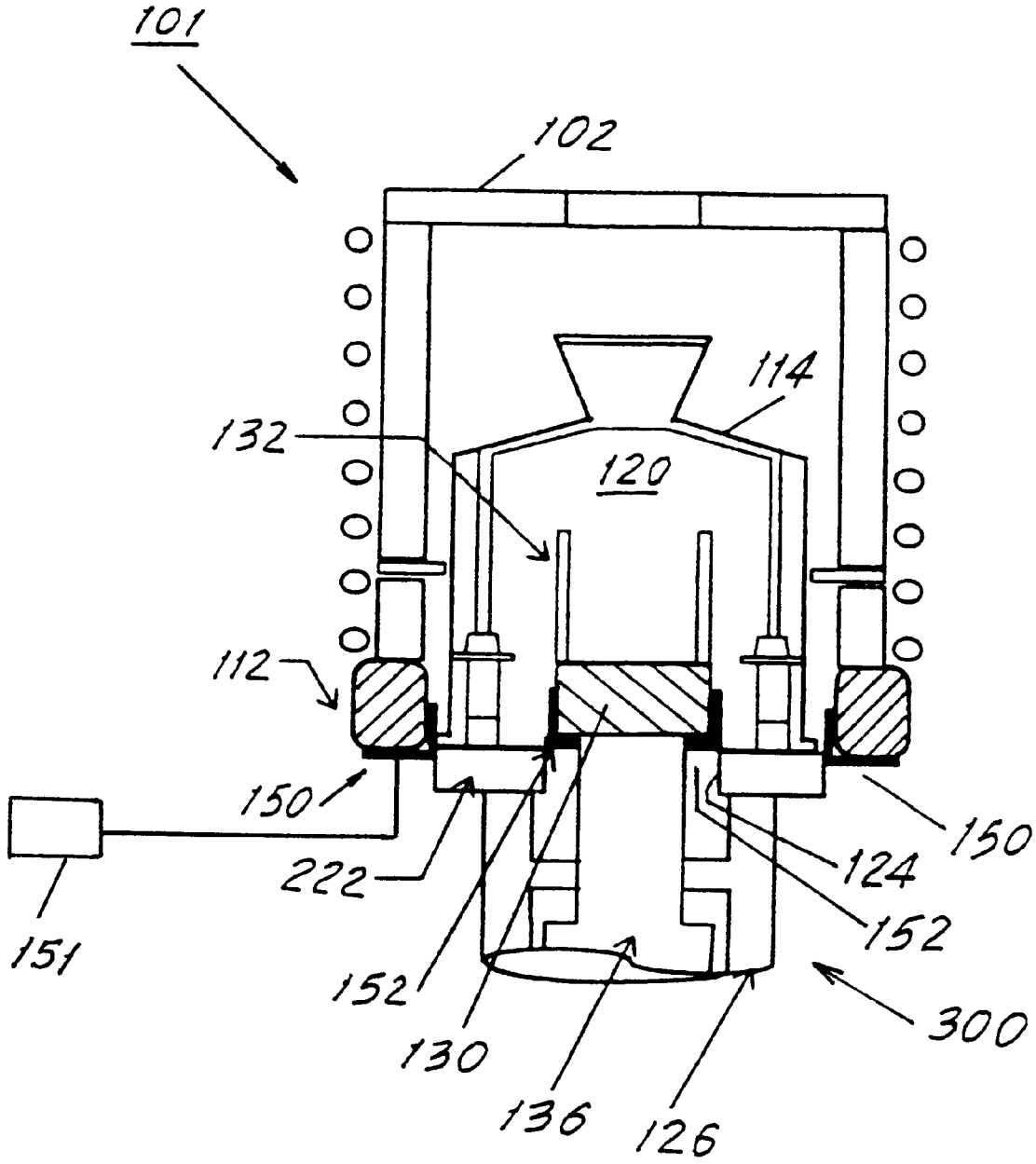
FIG. 4 is a side sectional view of another embodiment of a casting apparatus according to the present invention.

FIG. 4 illustrates a side sectional view of another embodiment of the present invention. The casting apparatus 101 of this embodiment includes an annular chill plate 222 having a central aperture 124 which communicates with the substantially open lower end of the mold apparatus 114 such that the interior space 120 of the mold apparatus 114 is accessible through the aperture 124.

The apparatus 101 includes an elevator mechanism 300 having an outer annular column 126 coupled at its top end to the lower surface of the chill plate 222 and at an opposite bottom end to an actuator (not shown) capable of vertically displacing the column 126, the chill plate 222 on the column 126, and the mold apparatus 114 on the chill plate 222 with respect to the fixed height heating chamber 102. The water used to internally cool chill plate 222 is provided through column 126.

The elevator mechanism 300 supports an inner cooling spool 130 that is movable through the aperture 124 in the chill plate 222 and into and out of the interior space 120 of the mold apparatus 114. The inner cooling spool 130 is substantially disk shaped and capable of absorbing radiant heat from the interior space 120 of the mold apparatus 114. It is preferred that the inner cooling spool 130 be formed from a copper and/or steel material and be water cooled. The water used to internally cool internal cooling spool 130 is provided through column 136.

An upstanding, annular, cylindrical reflective shield 132 is disposed atop the inner cooling spool 130. The exterior of the reflective shield 132 provides a reflective surface that is directed substantially toward the mold apparatus 114 and reflects radiant heat energy back toward the mold apparatus 114.

A second coaxial inner column 136 has its top end coupled to the lower surface of the inner cooling spool 130 and has its opposite bottom end coupled to another actuator (not shown). The actuator displaces the column 136, the inner cooling spool 130, and the reflective shield 132 together and with respect to the mold apparatus 114 and the heating chamber 102.

Some further control of the temperature gradient is provided by the movable inner cooling spool 130, the reflective shield 132, and the movable mold apparatus 114, as described below.

The elevator mechanism 300 permits variability in the temperature gradient to be obtained while the mold apparatus 114 is withdrawn from the heating chamber 102 without requiring that the heating chamber 102 be moved. Additional details on the structure and operation of the elevator mechanism 300 may be found in related U.S. patent application Ser. No. 09/304,977, filed May 4, 1999, entitled WITHDRAWAL ELEVATOR MECHANISM FOR WITHDRAWAL FURNACE WITH A CENTER COOLING SPOOL TO PRODUCE DS/SC TURBINE AIRFOILS, the entire disclosure of which is hereby incorporated by reference.

Outer cooling spool 112 includes an outer spool shield 150 at its lower inner corner region as in the first embodiment of FIG. 3. Inner cooling spool 130 includes an inner spool shield 152 which generally covers the outer surface of the inner cooling spool and could cover the entire outer surface. In one embodiment the inner spool shield has an L-shaped cross section and extends around its lower end and its periphery. Depending upon the height positions of the spool shields 150, 152 along their respective spools, the spool shields 150, 152 restrict the amount of the radiant heat passing into the respective cooling spools and also reflect that heat back toward the mold apparatus 114. The spool shields 150, 152 are preferably formed with refractory materials, such as alumina, zirconia or carbon-carbon composite. The spool shields 150 and 152 are each movable (e.g., vertically) with respect to their respective cooling spools 112, 130 to variably adjust the central, radially facing surface areas of the spools which are available to absorb radiant heat and, therefore, to control thermal gradients. Preferably, each of the spool shields 150, 152 is independently movable via a controller (not shown).

Advantageously, the introduction of one or both of spool shields 150, 152 provide additional control over the thermal gradient established during the withdrawal process, thereby enabling castings of even more complex configurations to be directionally solidified or single crystal. For example, the casting apparatus of the present invention is capable of changing the thermal gradients through one casting cycle. It is also capable of producing different thermal gradients through different castings during the same withdrawal process.

The foregoing description of the preferred embodiments of the present invention has been provided for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A casting apparatus, comprising:

a heating chamber having an open lower end defined by a periphery;

a chill plate for supporting at least one casting mold thereon, the chill plate being movable with respect to the lower end of the heating chamber to support the at least one casting mold in the heating chamber and to withdraw the at least one casting mold from the heating chamber;

a cooling spool disposed at the periphery of the open lower end of the heating chamber and including a surface area for receiving heat energy radiated from at least one of the heating chamber and the at least one casting mold; and a spool shield disposed at the cooling spool and operable to control an amount of the surface area of the cooling spool available for receiving the heat energy.

2. The casting apparatus of claim 1, wherein the cooling spool is substantially ring shaped having a central radially inwardly facing surface area and a lower surface area facing out of the heating chamber, the surface areas being disposed to face the at least one casting mold as the at least one casting mold is withdrawn from the heating chamber, the spool shield being movable with respect to the cooling spool such that it is operable to variably cover at least a portion of the central and lower surface areas of the cooling spool.

3. The casting apparatus of claim 1, wherein the spool shield is movable with respect to the cooling spool to vary the amount of the surface area of the cooling spool available for receiving the heat energy.

4. The casting apparatus of claim 3, wherein the spool shield is operable to vary at least one thermal gradient through the at least one casting mold as a function of the amount of the surface area of the cooling spool available for receiving the heat energy.

5. The casting apparatus of claim 4, wherein the spool shield is operable to control a first thermal gradient through one part of the at least one casting mold and a second thermal gradient through another part of the same at least one casting mold as a function of relative positions of the spool shield and the cooling spool.

6. The casting apparatus of claim 4, wherein when there are at least two of the casting molds, the spool shield is operable to control a first thermal gradient through one of the at least two casting molds and a second thermal gradient through another one of the at least two casting molds as a function of relative positions of the spool shield and the cooling spool.

7. The casting apparatus of claim 3, wherein the spool shield is independently movable with respect to both the cooling spool and the chill plate.

8. The casting apparatus of claim 1, wherein the spool shield is sized and shaped such that it is capable of blocking a substantial portion of the surface area of the cooling spool facing the at least one casting mold.

9. The casting apparatus of claim 8, wherein the spool shield includes a reflective surface facing the at least one casting mold for reflecting thermal energy back towards the at least one casting mold.

10. The casting apparatus of claim 9, wherein at least the reflective surface of the spool shield is formed from a refractory material.

11. The casting apparatus of claim 10, wherein the refractory material is selected from the group consisting of alumina, zirconia and carbon-carbon composite.

12. A casting apparatus, comprising:

a heating chamber having an open lower end defined by a periphery;

a chill plate having a peripheral region for supporting a mold assembly of at least one casting mold, the chill plate having an aperture therethrough surrounded by the peripheral region, the chill plate being movable with respect to the lower end of the heating chamber to support the mold assembly in the heating chamber and to withdraw the mold assembly from the heating chamber;

an outer cooling spool disposed at the periphery of the open lower end of the heating chamber and including a first surface area for receiving heat energy radiated from at least one of the heating chamber and the at least one casting mold;

an outer spool shield disposed at the outer cooling spool and operable to control an amount of the first surface area of the outer cooling spool available for receiving the heat energy from the heating chamber or the at least one casting mold;

an inner cooling spool which is vertically movable through the aperture of the chill plate and into a space surrounded by the mold assembly, the inner cooling spool including a second surface area for receiving heat energy from the at least one casting mold; and an inner spool shield disposed at the inner cooling spool and operable to control an amount of the second surface area of the inner cooling spool available for receiving the heat energy from the at least one casting mold.

13. The casting apparatus of claim 12, wherein the outer and the inner spool shields are independently movable with respect to one another, the respective outer and inner spool and the chill plate.

14. The casting apparatus of claim 12, wherein:

the outer cooling spool is substantially ring shaped having a central radially inwardly facing surface area and a lower surface area facing out of the heating chamber, the surface areas being disposed to face the at least one casting mold as it is withdrawn from the heating chamber, the outer spool shield being movable with respect to the outer cooling spool such that it is operable to variably cover at least a portion of the central and lower surface areas of the outer cooling spool; and the inner cooling spool is substantially disc shaped having a side surface area disposed to face the at least one casting mold, the inner spool shield being movable with respect to the inner cooling spool to variably cover at least a portion of the side surface area of the inner cooling spool.

15. The casting apparatus of claim 12, wherein the outer spool shield is movable with respect to the outer cooling spool and the inner spool shield is movable with respect to the inner cooling spool to vary the respective first and second surface areas of the outer and the inner cooling spools available for receiving heat energy.

16. The casting apparatus of claim 15, wherein:

the outer spool shield is operable to vary at least one thermal gradient through the at least one casting mold as a function of the amount of the first surface area of the outer cooling spool available for receiving heat energy; and the inner spool shield is operable to vary at least one thermal gradient through the at least one casting mold as a function of the amount of the second surface area of the inner cooling spool available for receiving heat energy.

17. The casting apparatus of claim 16, wherein:

the outer spool shield is operable to control a first thermal gradient through one part of the at least one casting mold and a second thermal gradient through another part of that at least one casting mold as a function of relative positions of the outer spool shield and the outer cooling spool; and the inner spool shield is operable to control a third thermal gradient through one part of the at least one casting mold and a fourth thermal gradient through another part of that at least one casting mold as a function of relative positions of the inner spool shield and the inner cooling spool.

18. The casting apparatus of claim 16, wherein the outer and the inner spool shields are movable relative to one another to control a first thermal gradient through one part of the at least one casting mold and a second thermal gradient through another part of that at least one casting mold as a function of relative positions of the outer and spool inner shields and the outer and inner cooling spools, respectively.

19. The casting apparatus of claim 16, wherein:

when there are at least two of the casting molds, the outer spool shield is operable to control a first thermal gradient through one of the at least two casting molds and a second thermal gradient through another one of the at least two casting molds as a function of the relative positions of the outer spool shield and the outer cooling spool; and the inner spool shield is operable to control a third thermal gradient through one of the at least two casting molds and a fourth thermal gradient through another one of the at least two casting molds as a function of the relative positions of the inner spool shield and the inner cooling spool.

20. The casting apparatus of claim 16, wherein when there are at least two of the casting molds, the outer and the inner spool shields are movable relative to one another to control a first thermal gradient through one of the at least two casting molds and a second thermal gradient through another of the at least two casting molds as a function of the relative positions of the outer and the inner spool shields and the outer and the inner cooling spools, respectively.

21. The casting apparatus of claim 12, wherein each of the outer and the inner spool shields is sized and shaped such it is capable of blocking substantial portions of the respective surface areas of the outer and inner cooling spools facing the at least one casting mold.

22. The casting apparatus of claim 21, wherein each of the outer and the inner spool shields includes a reflective surface facing the at least one casting mold for reflecting thermal energy back towards the at least one casting mold.

23. The casting apparatus of claim 22, wherein at least the respective reflective surfaces of the outer and the inner spool shields are formed from refractory materials.

24. The casting apparatus of claim 23, wherein the refractory materials are selected from the group consisting of alumina, zirconia and carbon-carbon composite.

* * * * *